United States Patent [19]

Niggemann

[11] Patent Number: 4,527,514

[45] Date of Patent: Jul. 9, 1985

[54] DIRECT CONTACT LIQUID HEATER AND HEATING METHOD

[75] Inventor: Richard E. Niggemann, Rockford, Ill.

[73] Assignee: Sundstrand Corporation, Rockford, Ill.

[21] Appl. No.: 543,991

[22] Filed: Oct. 20, 1983

[51] Int. Cl.[3] ..... F22B 1/02

[52] U.S. Cl. ..... 122/31 R; 60/39.55; 60/915; 122/5.5 A

[58] Field of Search ..... 60/915, 39.53, 39.54, 60/39.55, 619; 122/28, 31 R, 31 A, 5.5 A; 110/260, 264, 265, 215

[56] References Cited

U.S. PATENT DOCUMENTS

| | | | |
|---|---|---|---|
| 2,417,835 | 3/1947 | Moore | 60/915 |
| 2,482,262 | 9/1949 | Goddard | 60/39.55 |
| 2,523,656 | 9/1950 | Goddard | 60/39.55 |
| 2,526,219 | 10/1950 | Goddard | 60/915 |
| 3,038,308 | 6/1962 | Fuller | 60/39.55 |
| 3,642,061 | 2/1972 | Waeselynck | 60/39.55 |

*Primary Examiner*—Henry C. Yuen
*Assistant Examiner*—Steven E. Warner
*Attorney, Agent, or Firm*—Wood, Dalton, Phillips, Mason & Rowe

[57] ABSTRACT

A direct contact water heater for heating water by the hot exhaust gases from a torpedo propulsion engine by imparting a swirl velocity to the exhaust gases and injecting water into the swirling exhaust gases to form the water into droplets which by the swirl velocity are centrifuged into a liquid annulus in a mixing chamber and with the exhaust gases flowing centrally thereof to an outlet. Structure at an end of the mixing chamber withdraws water from the liquid annulus for use.

4 Claims, 5 Drawing Figures

DIRECT CONTACT LIQUID HEATER AND HEATING METHOD

DESCRIPTION

1. Technical Field

This invention pertains to a direct contact liquid heater and heating method and, more particularly, to a water heater which heats the water by direct contact with hot exhaust gases from a torpedo propulsion engine. The heater utilizes an exhaust housing which receives the hot exhaust gases from a torpedo propulsion engine. The exhaust gases are given a swirl velocity and water is injected into the swirling exhaust gases to form the water into droplets which provide high values of heat and mass transfer coefficients as well as a large surface area in contact with the swirling gas stream. The droplets are centrifuged to form a liquid annulus and heated water is withdrawn from the liquid annulus. The heated water can be directed to a torpedo hull heat exchanger.

2. Background Art

It has been determined that operation of a torpedo is improved in the torpedo hull is heated and it is known to heat a torpedo hull electrically.

DISCLOSURE OF THE INVENTION

In engines that utilize the HAP/OTTO bi-propellant or other bi-propellants, high pressure combustion products are generated in a combustor and flow to a turbine. It is necessary to inject diluent water into the hot high pressure combustion products to cool the resultant mixture to a temperature level of approximately 2500° F. that will not melt or otherwise damage the metallic turbine wheel or nozzles. If this diluent water is preheated by the turbine exhaust gas prior to injection into the combustor, a reduction in the engine fuel consumption results.

It has also been shown that heating the hull of an underwater vehicle can laminarize the fluid dynamic boundary layer and effect a substantial reduction in vehicle drag.

The subject direct contact water heater is a very compact and lightweight approach to implementing waste heat recovery for either or both of these potential beneficial uses.

A feature of the invention is to provide means for heating a torpedo hull to improve operation of the torpedo with minimal size, weight and fuel consumption impact on the basic torpedo propulsion engine and, more particularly, by utilizing the hot exhaust gases from the torpedo propulsion engine.

An object of the invention is to provide a direct contact heater for heating a liquid by hot exhaust gases from an engine which utilizes an elongate tube through which the hot exhaust gases flow and which have a swirl velocity imparted thereto, an injector for injecting liquid into the swirling exhaust gases to form the liquid into droplets which are centrifuged into the form of a liquid annulus, with the bulk of the swirling exhaust gases flowing centrally thereof, and means for drawing liquid from the liquid annulus.

Still another object of the invention is to provide a direct contact heater as defined in the preceding paragraph for heating water by the hot exhaust gases from a torpedo propulsion engine wherein the elongate tube defines an exhaust housing and has an outlet for ocean discharge and a mixing chamber within the exhaust housing in which the liquid annulus forms.

A further feature of the invention is to provide a method of heating a liquid, such as water, by transfer of heat from the hot exhaust gases of an engine, such as a torpedo propulsion engine, which comprises imparting a swirl velocity to the exhaust gases, injecting liquid into the swirling exhaust gases for formation of liquid droplets, centrifuging the droplets to form a liquid annulus with the bulk of the swirling gases flowing interiorly of the liquid annulus, and withdrawing heated liquid from the liquid annulus.

BEST MODE FOR CARRYING OUT THE INVENTION

Figure 1:
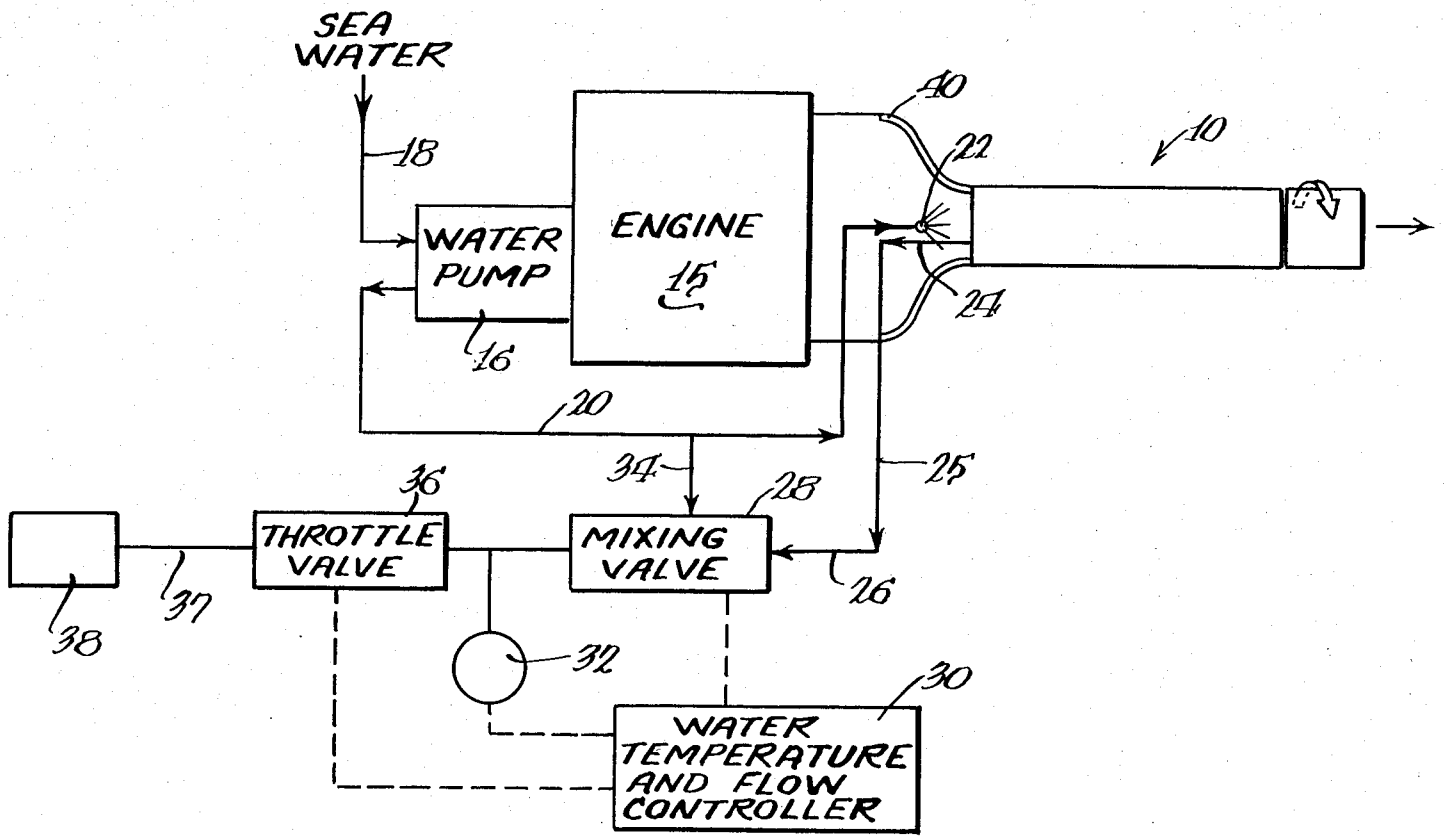
FIG. 1 is a schematic of the direct contact water heater and associated circuitry shown in association with a torpedo propulsion engine.

The over-all system is shown in FIG. 1 wherein the direct contact water heater, indicated generally at 10, is shown in association with a torpedo propulsion engine 15. The torpedo propulsion engine 15 is of a type that burns either an OTTO fuel or a HAP/OTTO fuel which gives off hot exhaust gases including some water vapor.

The engine 15 drives a water pump 16 which receives sea water through an inlet pipe 18 and pumps the sea water through a pipe 20 to a water injector, shown diagrammatically at 22 and which will be more fully described hereinafter. Water that is heated by the direct contact water heater flows therefrom through pipes 24, 25 and 26, with the latter pipe connecting into a mixing valve 28.

A desired temperature and flow rate of water is controlled by a water temperature and flow controller 30 which receives a temperature reading from a temperature-sensing and signalling device 32. The mixing valve 28 has an inlet pipe 34 connected to the water pipe 20 and the controller 30 controls the mixing valve to determine the amount of cold sea water that is added to the heated water for the desired water temperature. The controller 30 also controls a throttle valve 36 to determine the flow rate through the pipe 37 to a torpedo hull heat exchanger 38 for heating of the torpedo hull to promote low drag through the water.

Figure 2A:
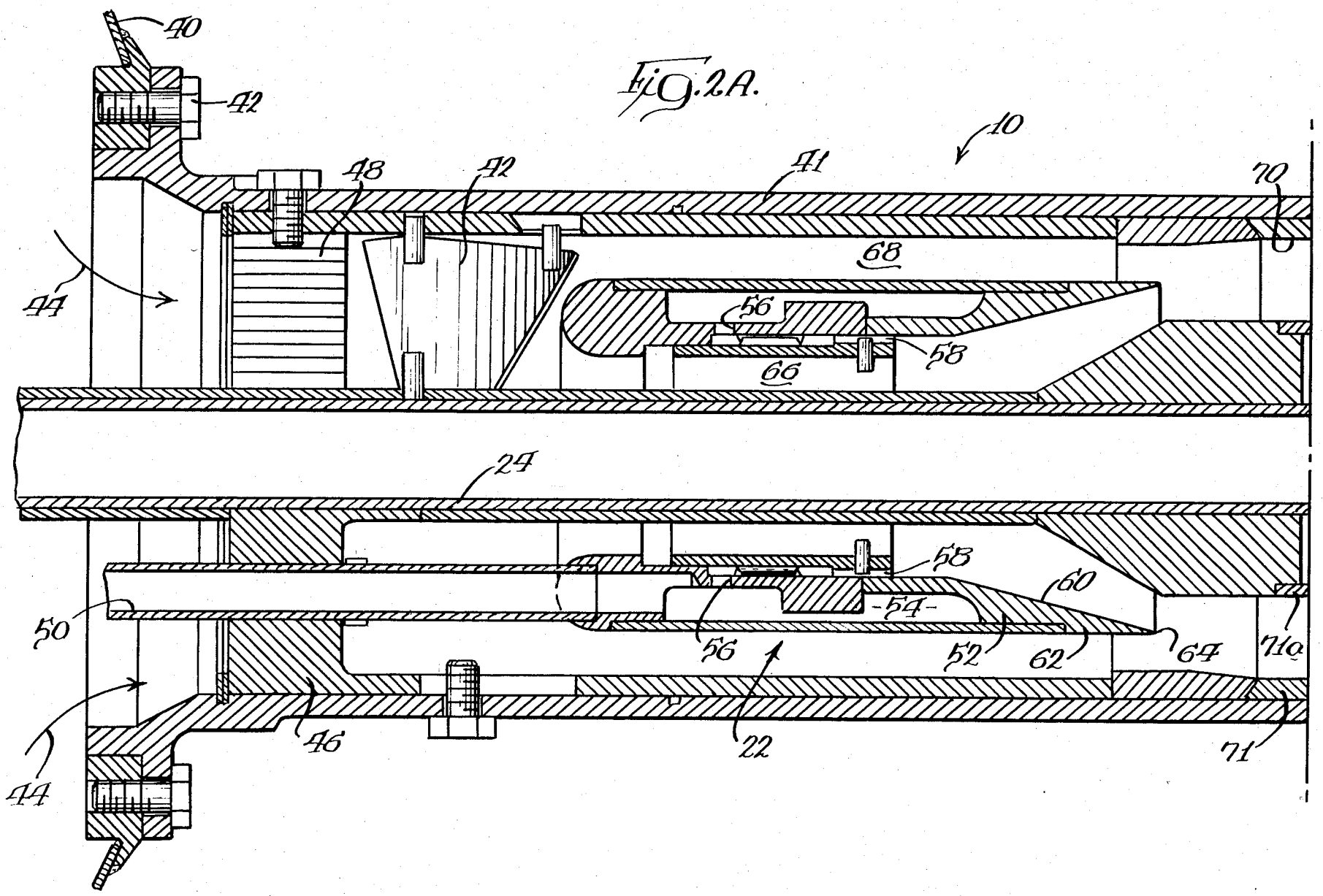
FIG. 2A is a central vertical section of a left-hand portion of one embodiment of the direct contact water heater attached to a torpedo propulsion engine shown fragmentarily.
Figure 2B:
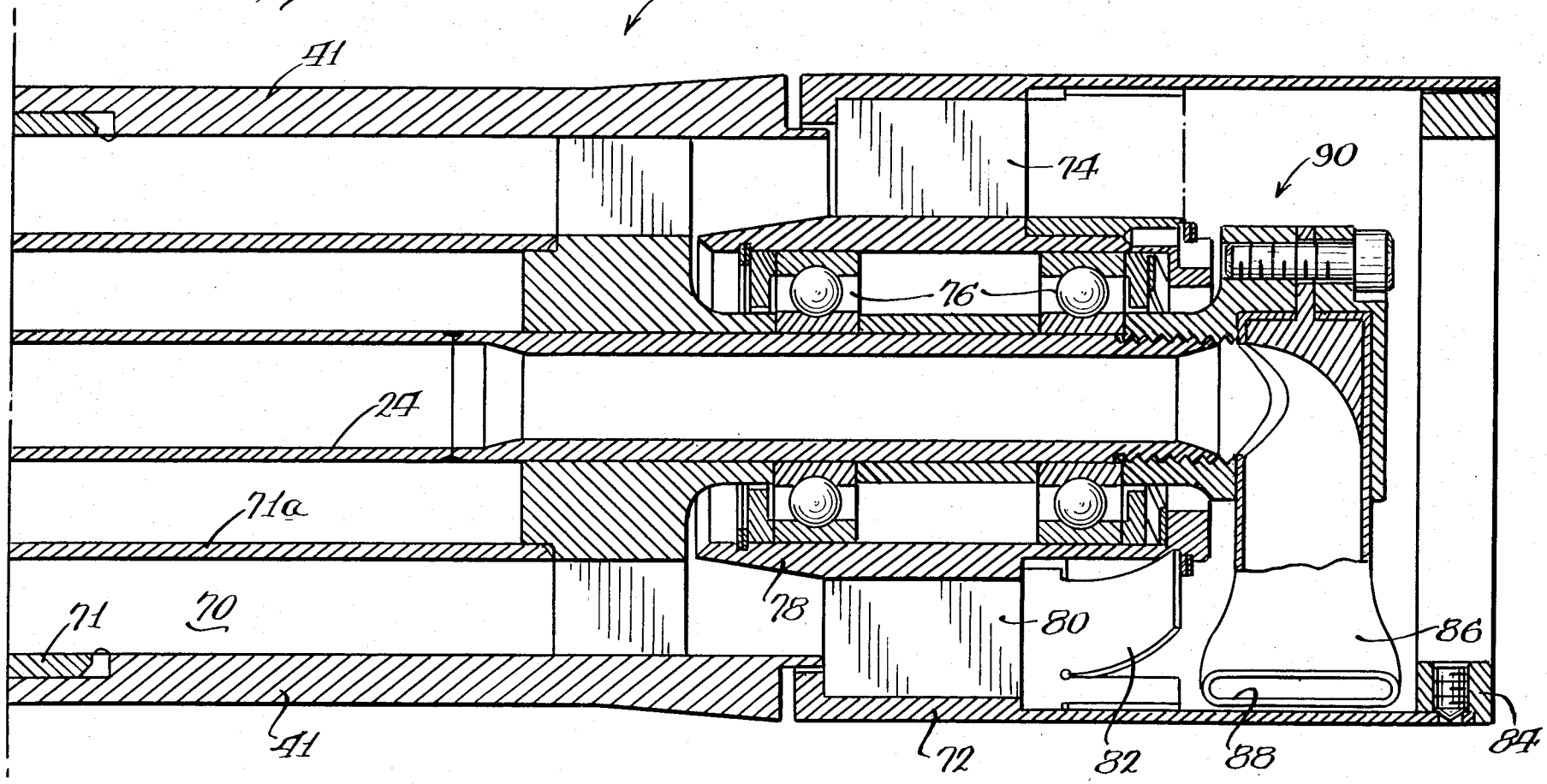
FIG. 2B is a central vertical section of a right-hand portion of the direct contact water heater, with FIGS. 2A and 2B together showing the entire water heater.
Figure 3:
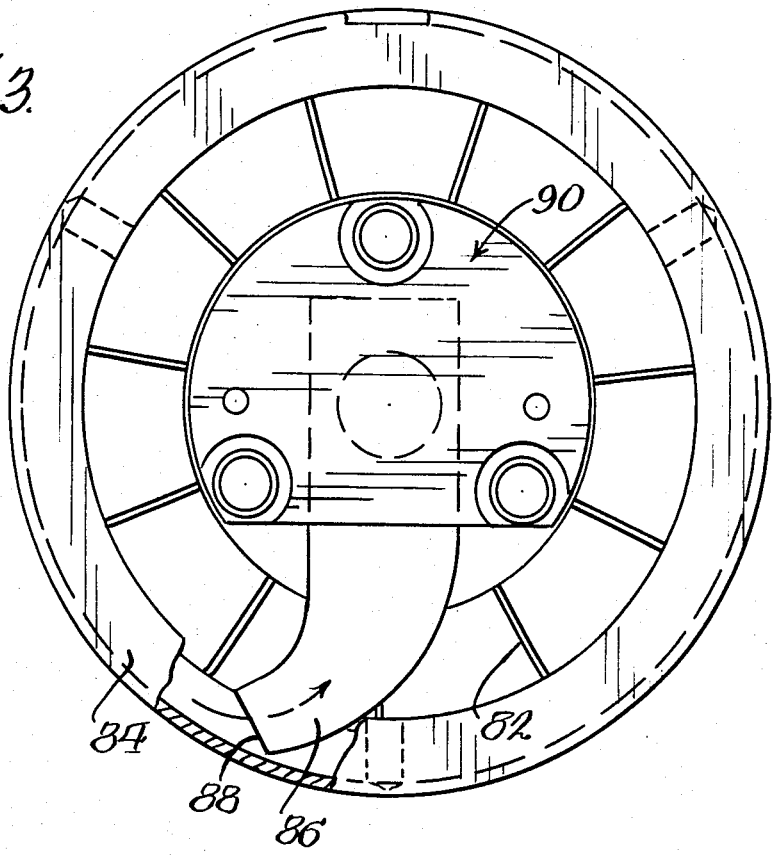
FIG. 3 is an end view, looking toward the right-hand end of FIG. 2B, with parts broken away.

One embodiment of the direct contact water heater 10 is shown in FIGS. 2A and 2B.

The torpedo propulsion engine 15 has an exhaust housing, with a concave section 40, shown fragmentarily in FIG. 2A, connected to an elongate tube 41 forming a continuation of the exhaust housing by means of threaded members 42.

A plurality of swirl blades 42 is positioned within the elongate tube 41. These swirl blades extend radially outward from the hot water return pipe 24 disposed centrally of the exhaust housing and are circumferentially spaced from each other. The hot exhaust gases from the torpedo propulsion engine 15 flow in the direction of the arrows 44 in FIG. 2A and have a relatively high velocity and may have some swirl action as they flow toward the swirl blades. In order to have the swirl blades impart a controlled swirl velocity to the hot exhaust gases, a multi-armed member 46 is positioned ahead of the swirl blades 42, with the spaces between the arms being filled by a honeycomb-type material 48 which permits the gases to continue to flow at high velocity but which directs them along a relatively straight path toward the swirl blades. The arms of the member 46 each have a pipe 50 extended therethrough which connects to the pump outlet pipe 20 whereby water can be delivered to the water injector 22 which is to be described.

The water injector 22 is positioned within the elongate tube 41 and has a casing 52 defining an annular chamber 54 which communicates with the pipes 50 for receiving water from the water pump 16. This water is caused to flow from the annular chamber through openings 56 and 58 to flow as a film along the surface 60 of an annular section 62 of the water injector casing. As the film of water reaches an edge 64 of the surface 60, the swirling exhaust gases flowing through an annular space 66 interiorly of the water injector casing 52 and an annular space 68 between the water injector casing 52 and the wall of the exhaust housing acts on the film of water to form the water into droplets. The speed of the exhaust gases increases as they flow through the annular spaces 66 and 68 and the swirling exhaust gases impart a swirl velocity to the droplets whereby they are centrifuged onto the interior surface of a mixing chamber 70 immediately downstream of the water injector 22.

The liquid film at the edge 64 of the water injector is rapidly atomized by the swirling gas stream into very small droplets and these droplets provide high values of heat and mass transfer coefficients as well as a large surface area per unit of water flow rate in contact with the swirling exhaust gases. The mass transfer results from steam vapor in the hot exhaust gases condensing on the water droplets. In addition to the heat and mass transfer coefficients, there is a high interfacial surface area between the droplets which form into a liquid annulus at the wall of the mixing chamber 70. The bulk of the swirling exhaust gases travel interiorly of the liquid annulus toward an outlet end of the exhaust housing. The interaction between the high velocity swirling exhaust gases and the cold sea water injected into it at the water injector 22 produces a large number of very small liquid droplets which can be approximately 20 microns in diameter. The exhaust gases have sufficient swirl velocity so that the average liquid droplet reaches the mixing chamber 70 of the exhaust housing before the exhaust gas which atomized that droplet leaves the mixing chamber 70. The mixing chamber 70 is within the elongate tube 41 and is defined by a pair of spaced-apart sleeves 71 and 71A.

The liquid annulus flows as stratified flow along the mixing chamber 70 of the exhaust housing to means for collecting and withdrawing water from the water heater. In the embodiment of FIGS. 2A and 2B, this means comprises a pitot probe pump having a cylindrical pump housing 72 rotatably mounted on the hot water return pipe 24 by bearings 76 which rotatably support a sleeve 78 having arms 80 which extend to the cylindrical pump housing 72. A series of impeller blades 82 are circularly arrayed about the sleeve 78 and are angled to the path of exhaust gas flow from the exhaust housing whereby the pump housing 72 is caused to rotate. Water flowing in the form of a liquid annulus from the mixing chamber 70 into the pump housing 72 is a relatively thin layer of liquid and the thickness of this layer is increased by an annular member 84 forming a dam at an end of the pump housing 72. Rotation of the pump housing imparts velocity pressure to the liquid annulus. A pitot pump probe 86 has its inlet 88 located adjacent the member 84 to lie within the layer of water in the liquid annulus. The pitot pump probe 86 receives water due to the velocity pressure and connects to an inlet end of the hot water pipe 24 and is mounted thereon by structure generally indicated at 90. Excess water can flow over the dam 84 and discharge to the ocean along with the exhaust gases.

Figure 4:
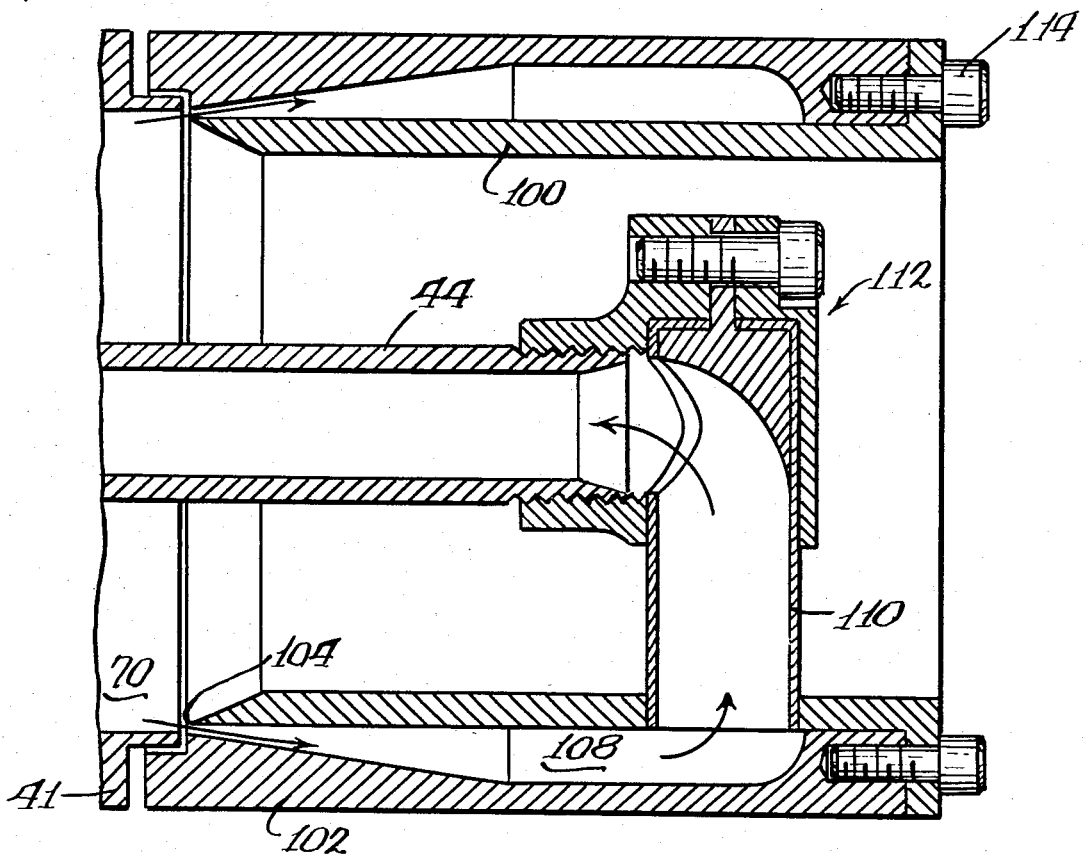
FIG. 4 is a view, similar to a portion of FIG. 2B, showing an alternate embodiment of a portion of the direct contact water heater.

An alternate embodiment for collecting water from the liquid annulus leaving the mixing chamber 70 and discharging water to the hot water pipe 24 is shown in FIG. 4. In this embodiment, an annular weir 100 is positioned within a nonrotatable tubular member 102. The annular weir 100 functions to thicken the layer of water in the liquid annulus and an annular opening 104 is provided through or at the outer edge of the weir whereby water from the liquid annulus can flow to an annular space 108 which communicates with a pipe 110 which is suitably fastened to the hot water return pipe 24 by attaching structure shown at 112. The static pressure of the water causes flow through the return pipe 24 to the mixing valve 28. The annular weir is supported from pipe 110 and supports the tubular member 102 through fastening members 114. Excess water can flow through the center of the weir 100 for ocean discharge.

The direct contact water heater utilizes the hot exhaust gases from a torpedo propulsion engine to form injected water into droplets which pick up heat by heat and mass transfer and although the time in which each droplet travels through the swirling exhaust gases is very small, substantial amounts of heat are transferred to the droplets. The droplets travel through the gases, with a radially outward velocity resulting from the centripetal acceleration provided by the swirling exhaust gases.

From the foregoing, it will be evident that a method of heating water by transfer of heat from the hot exhaust gases of a torpedo propulsion engine comprises the steps of imparting a swirl velocity to the exhaust gases prior to flow thereof to a mixing chamber, injecting water into the swirling exhaust gases immediately prior to entry thereof into the mixing chamber for formation of water droplets and transfer of heat thereto, confining the water droplets to the shape of a liquid annulus in the mixing chamber with the swirling gases flowing interiorly of the liquid annulus and with the gases and liquid annulus flowing toward an outlet and withdrawing heated water from the liquid annulus as it leaves the mixing chamber.

Although the invention has been described particularly with reference to the heating of water through direct contact with exhaust gases from a torpedo propulsion engine, it will be evident that the invention has applicability to heating of liquids other than water by hot exhaust gases from engines other than a torpedo propulsion engine.

I claim:

1. A direct contact water heater for heating water by the hot exhaust gases from a torpedo propulsion engine comprising, an elongate exhaust housing having an inlet connectable to the exhaust gas discharge of the torpedo propulsion engine and an outlet for ocean discharge, a mixing chamber intermediate the ends of the exhaust housing having a tubular wall, means for imparting a swirl velocity to exhaust gases entering said exhaust housing whereby swirling exhaust gases enter said mixing chamber, means for injecting water into said swirling exhaust gases immediately ahead of said mixing chamber to form water droplets which are centrifuged toward said wall of the mixing chamber to form a liquid annulus which moves along the length of the mixing chamber with the bulk of the swirling exhaust gases flowing centrally of the mixing chamber and inside the liquid annulus toward the exhaust housing outlet, and means at the end of the mixing chamber for collecting water from the liquid annulus and discharging the water from the water heater comprising a tubular pump housing rotatably mounted at an end of the exhaust housing and having a wall forming a continuation of the mixing chamber wall to receive the liquid annulus, means carried by the pump housing for rotating the pump housing in response to the flow of exhaust gases, and a pitot pump probe having an inlet position adjacent the pump housing wall to receive water from the liquid annulus.

2. A direct contact water heater as defined in claim 1 wherein said means for imparting a swirl velocity to the exhaust gases comprises a plurality of swirl blades positioned in the exhaust housing adjacent said exhaust housing inlet.

3. A direct contact water heater as defined in claim 1 wherein said means for injecting water comprises a water injector with means for flowing a film of water into the swirling exhaust gases.

4. A direct contact water heater for heating water by the hot exhaust gases from a torpedo propulsion engine comprising, an elongate exhaust housing having an inlet connectable to the exhaust gas discharge of the torpedo propulsion engine and an outlet for ocean discharge, a mixing chamber intermediate the ends of the exhaust housing having a tubular wall, means for imparting a swirl velocity to exhaust gases entering said exhaust housing whereby swirling exhaust gases enter said mixing chamber, means for injecting water into said swirling exhaust gases immediately ahead of said mixing chamber to form water droplets which are centrifuged toward said wall of the mixing chamber to form a liquid annulus which moves along the length of the mixing chamber with the bulk of the swirling exhaust gases flowing centrally of the mixing chamber and inside the liquid annulus toward the exhaust housing outlet, and means at the end of the mixing chamber for collecting water from the liquid annulus and discharging the water from the water heater comprising a pump housing rotatably mounted at an end of the elongate tube and having a wall forming a continuation of the mixing chamber wall to receive the liquid annulus, and a pitot pump probe having an inlet positioned adjacent the pump housing wall to receive liquid from the liquid annulus.

* * * * *